US005742272A

United States Patent [19]

Kitamura et al.

[11] Patent Number: 5,742,272

[45] Date of Patent: Apr. 21, 1998

[54] ACCELERATED FULL SCREEN VIDEO PLAYBACK

[75] Inventors: John Kitamura, Toronto; Indra Laksono, Richmond Hill; Adrian H. Hartog, Toronto, all of Canada

[73] Assignee: ATI Technologies Inc., Thornhill, Canada

[21] Appl. No.: 638,808

[22] Filed: Apr. 29, 1996

[51] Int. Cl.[6] ..... G09G 5/00

[52] U.S. Cl. ..... 345/127; 345/130; 345/132; 395/139

[58] Field of Search ..... 345/122, 127, 345/128, 130, 132, 202; 395/139; 348/445, 458

[56] References Cited

U.S. PATENT DOCUMENTS 5,351,064 9/1994 Zenda ..... 345/130
5,532,716 7/1996 Sano ..... 345/127
5,600,347 2/1997 Thompson et al. ..... 345/127
5,621,870 4/1997 Shyu et al. ..... 395/139

*Primary Examiner*—Mark R. Powell
*Assistant Examiner*—Matthew Luu
*Attorney, Agent, or Firm*—E. E. Pascal; R. A. Wilkes

[57] ABSTRACT

A method of drawing moving images on a graphics display comprising (a) receiving data defining an input image in a predetermined resolution, (b) commanding a graphics processor to draw a corresponding image frame on a display having a number of scanning lines which is a multiple m of a number of scanning lines of the input image and a multiple n of a number of pixels in a horizontal line of the input image, (c) drawing successive lines of the input image on a first and on each $m^{th}$ scanning line of the graphics display, while stretching each pixel on each drawn line over n pixels, (d) copying each drawn line on respective immediately following m−1 lines, and (e) repeating steps (b)–(d) for successive frames of the input image.

6 Claims, 1 Drawing Sheet

ACCELERATED FULL SCREEN VIDEO PLAYBACK

FIELD OF THE INVENTION

This invention relates to the field of computers and in particular to a method of displaying video or other moving images.

BACKGROUND TO THE INVENTION

A common form of data transmission and storage of video images is in an MPEG (IS093) compressed stream. The MPEG compression standard is commonly restricted to Standard Interchange Format (SIF) resolutions. SIF limits the video to a set of resolutions between 352 and 384 pixels wide and between 240 and 288 pixels high. In order to display these images at full screen, they must be upscaled. For example, when running under the Microsoft, Inc. Windows program at 640×480 pixels, an SIF file must be upscaled by approximately two times in both horizontal and vertical direction. In resolution of 1024×768, the video image must be upscaled by approximately four times in each direction.

The scaling process presents at least two problems. Firstly, upscaling an image by two times increases the amount of data required for the display by four times, which requires increased memory to accommodate the increased data.

The speed at which this increased data can be written from the host memory to the graphics engine's display memory (VRAM) is limited. Therefore if the amount of data comprising a frame of video is increased, the number of frames per second that can be written decreases. In other words, increased bandwidth due to upscaling reduces frame rates due to the limited bandwidth in the display path.

Next, scaling of non-integer values is computationally expensive. Non-integer scaling must be done with filtering, otherwise scaling artifacts will be noticeable in the displayed image.

The only efficient way to display full screen video has been to use special purpose hardware, which would accept the native size video, scale it accordingly, and overlay the scaled data on the onscreen surface to be displayed.

SUMMARY OF THE INVENTION

In accordance with an embodiment of the present invention, the data defining an input frame of an image is uploaded to the computer drawing engine memory, with a command to the drawing engine to draw the frame of data. A modified Windows resolution is chosen to suit the size of the input frames. Standard Windows resolutions are modified by altering the horizontal clock rate. The horizontal clock is used to draw each pixel of the input image on a line is drawn at a number of successive horizontal pixel positions. The horizontal clock speed is reduced in accordance with a predetermined fraction depending on the ratio of the horizontal size of the original image to the horizontal size of the image to be drawn, in effect stretching each source image pixel over several display pixels.

A graphics engine accesses the memory and draws the lines of the image, skipping scanning lines in accordance with a predetermined multiple depending on the ratio of the vertical size of the image to be drawn to the vertical size of the original image. A blit engine in the graphics engine then copies from the memory each drawn line on successive immediately following previously skipped lines.

In this manner, the channel capacity carrying the frame data to the graphics engine need not be expanded to accommodate the increased data required for the full screen, since data only of the source image passes over the buses. The blit engine relieves the host processor from calculating the data required to provide a larger display. The display frame rate however need not be reduced since the function of copying lines and pixels is performed by the blit engine, which is independent of the host processor. The blit engine operates in parallel with the host processor.

In accordance with an embodiment of the invention, a method of drawing moving images on a graphics display is comprised of (a) receiving data defining an input image in a predetermined resolution, (b) commanding a graphics processor to draw a corresponding image frame on a display having a number of scanning lines which is a multiple m of a number of scanning lines of the input image and a multiple n of a number of pixels in a horizontal line of the input image, (c) drawing successive lines of the input image on a first and on each $m^{th}$ scanning line of the graphics display, while stretching each pixel on each drawn line over n pixels, (d) copying each drawn line on respective immediately following m−1 lines, and (e) repeating steps (b)–(d) for successive frames of the input image.

Reference is made to the text "Graphics Programming For The 8514/A", by Jake Richter & Bud Smith, copyright 1990 by M & T Publishing, Inc. of Redwood City, Calif., for a detailed description of graphics engines and bit block transfer (blit) devices (engines) and processes which copy blocks of data.

BRIEF INTRODUCTION TO THE DRAWINGS

A better understanding of the invention will be obtained by considering the detailed description below, with reference to the following drawings, in which:

FIG. 1 is a block diagram of pertinent elements of a personal computer, with an additional element of a blit engine in the graphics processor, on which the present invention can operate, and FIGS. 2, 3 and 4 are representative displays in three stages of processing in accordance with an embodiment of the present invention, with pixels enlarged and distorted for clarity of understanding of the invention.

DETAILED DESCRIPTION OF EMBODIMENTS OF THE INVENTION

The present invention will be described with reference to the aforenoted well known Windows program, although other programs can use the concepts described herein.

Figure 1:
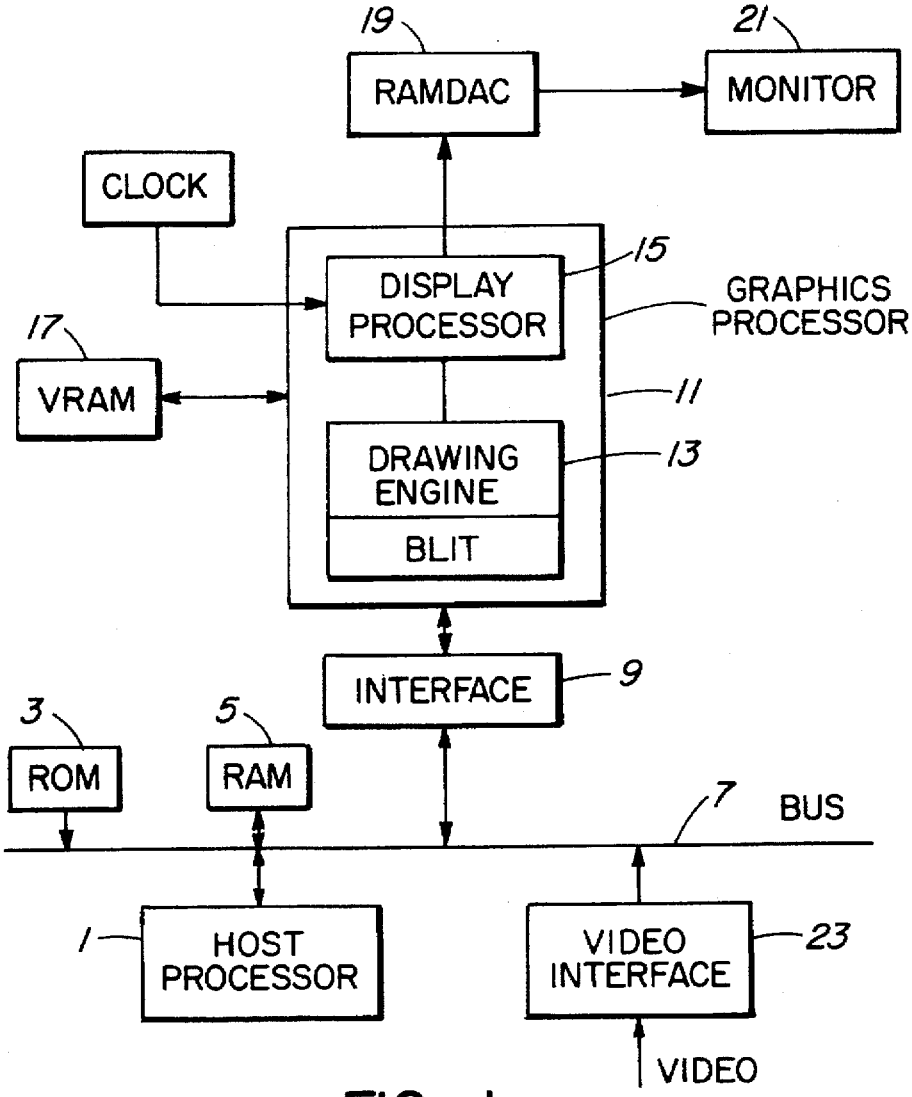

FIG. 1 is a block diagram of pertinent part of a personal computer, on which the present invention may be implemented. A host processor 1, a read only memory (ROM) 3 and a random access memory (RAM) 5 are connected to an expansion bus 7. A PC interface circuit 9 connects between the bus 7 and a graphics processor 11. The graphics processor contains a drawing engine 13 and a display processor 15, which are connected to a memory VRAM 17. The display processor is connected to the drawing engine and to a random access memory, digital to analog converter (RAMDAC) 19, which is connected to a display (monitor) 21.

Operation of the above system is known, and is described in the aforenoted text.

A video input circuit 23 is connected to the bus 7, and receives video image display data e.g. in the MPEG SIF standard format, passing it under control of the host processor at which point it is decoded into uncompressed frames, which are written to RAM 5 for temporary storage, and later uploaded it on a frame by frame basis with control instructions to the graphics processor 11.

The graphics processor contains a blit engine, which is a known hardware device that can copy blocks of data from one part of the memory to another. In an embodiment of the present invention, for reasons to be described more fully below, the blit is controlled by the drawing engine on command by the host processor, if necessary, to copy each line of source image data to one line address or to addresses of several successive additional lines in the VRAM which allows the display processor to read single line data at addresses relating to plural successive lines, but which will contain similar pixel data. Once copied and a line of data having been read for display, this allows the VRAM to be loaded with data relating to a new frame of data before the entire upscaled image has been fully displayed.

Alternatively, the blit can be deleted and data not copied to plural line addresses in the VRAM, but the graphics processor provides to the display processor, as a result of data passed to it from the host processor, an instruction to read the lines of data in VRAM multiple times, for the reason to be described below. During the last line read, or after the last frame has been read, or as the memory is last read to complete the frame, the data in the VRAM can be uploaded by the host processor with data representing the next frame.

To display video in full screen mode, the mode of Windows should be changed. That is, the display resolution and pixel depth is changed on-the-fly, while Windows is running. The timing parameters of its 640×480 resolution are modified by reducing the speed of the pixel display clock to generate 352 pixels per line, instead of 640. In this manner, a non-standard mode of 352×480 is set up. Similarly, as will be described later, to accommodate other SIF formats, resolutions of 352×600, 368×600 and 384×480 can be set up. Thus the standard 352 pixels of the SIF MPEG will be written to a screen of 640 pixels.

Once the display is in the 352×480 mode, a 352×240 pixel video stream can be upscaled. For example, it can be upscaled by a value of 2 as will be described below.

The frame of 352×480 pixels is received e.g. by video interface 23 to the computer. The frame can be stored in a local memory 5, if provided for in the video application, and is uploaded via the PC bus 7 and PC interface 9 to the drawing engine 13 of the graphics processor 11, which causes it to be stored in the VRAM. The host processor also issues a command to the graphics processor to draw the frame on the monitor.

The display processor 15 of the graphics processor 11 then reads the VRAM, obtaining the image pixel data to be displayed line by line, and provides the data with vertical line increment data to the RAMDAC for conversion to analog form and transfer to the monitor for display. The vertical increment data causes the pixel data to be displayed by monitor 21 on the first line and on each line which is a multiple m of the ratio of the display image to the input image. Thus for example if the image is to be displayed in 480 lines and the input image is 240 lines, input data will be displayed on every alternate line on the display.

Since 352 pixels of a line of the input image is displayed on 640 pixels of the display, but over the timing of 352 pixels, each of the 352 pixels will be spread over n pixels of a line, wherein multiple n is approximately the ratio of the number of pixels of the display to the number of pixels in a line of the frame of the input image.

Figure 2:
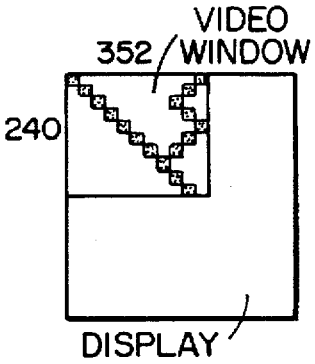
Figure 3:
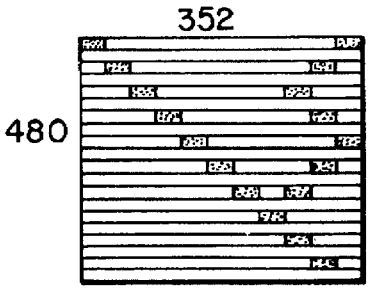

The above steps can be seen in FIGS. 2 and 3, wherein in FIG. 2 the input image is shown, with 352 pixels (black rectangles) horizontally and 240 lines vertically. FIG. 3 shows the display of each vertical input line on respective alternate (e.g. odd) vertical lines. FIG. 3 also shows display of the pixels in each line over several pixels, i.e. the data of each pixel is reproduced (stretched) by n horizontally adjacent pixels.

In the last step, if a blit engine is used, it performs a copy function, and copies each line of pixels to successive skipped (even) lines. This results in vertically stretched pixels, as shown in FIG. 4.

Figure 4:
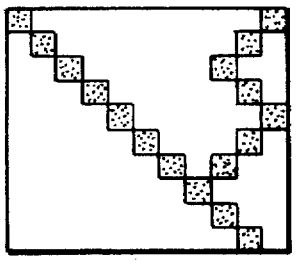

The original small, compressed image shown in FIG. 2 has thus been upscaled in both horizontal and vertical directions to the full screen size as shown in FIG. 4. By uploading a vertical upscaling parameter (e.g. m) and a clock speed parameter to graphics processor, the host processor has caused the input image to be upscaled but has avoided the requirement to increase the bandwidth necessary to display the upscaled image, and has reduced the processing time to perform the upscale.

It should be recognized that the invention can be implemented using only vertical or horizontal scaling, and can be implemented with different scaling factors m and n to achieve different display sizes of an input image other than full screen, or to full screen display sizes having different horizontal and/or different vertical dimensions. The invention is also not limited to video displays nor to SIF MPEG images, since the principles are applicable to any process in which images requiring a fast frame rate is required, such as animations or rendered motion in games.

Parameter timings for the Mach64 graphics accelerator sold by ATI Technologies Inc. for special resolutions of different CRT modes are reproduced in Appendix A, attached hereto.

A person understanding this invention may now conceive of alternative structures and embodiments or variations of the above. All those which fall within the scope of the claims appended hereto are considered to be part of the present invention.

APPENDIX A

Mach64 CRT Parameter Timings for 352x480 60Hz non-interlaced mode:

H_TOTAL =0x36 H_DISP =0x2B H_SYNC_STRT=0x2C H_SYNC_WID=0x27
V_TOTAL =0x020C V_DISP =0x01DF V_SYNC_STRT=0x01E9 V_SYNC_WID=0x22
H_SYNC_DLY=0x00 GEN_CNTL =0x00 CLOCK_CTL =0x08 DOT_CLOCK =13.85Mhz h_frequency = 31.477KHz v_frequency = 59.96Hz
h_polarity = (-) XTAL = OFF v_polarity = (-) CS = OFF Mach64 CRT Parameter Timings for 352x600 60Hz non-interlaced mode:

H_TOTAL =0x39 H_DISP =0x2B H_SYNC_STRT=0x2D H_SYNC_WID=0x07
V_TOTAL =0x0273 V_DISP =0x0257 V_SYNC_STRT=0x0258 V_SYNC_WID=0x04
H_SYNC_DLY=0x00 GEN_CNTL =0x00 CLOCK_CTL =0x08 DOT_CLOCK =17.60Mhz h_frequency = 37.931KHz v_frequency = 60.40Hz
h_polarity = (+) XTAL = OFF v_polarity = (+) CS = OFF Mach64 CRT Parameter Timings for 368x480 59Hz non-interlaced mode:

H_TOTAL =0x39 H_DISP =0x2D H_SYNC_STRT=0x2E H_SYNC_WID=0x27
V_TOTAL =0x020C V_DISP =0x01DF V_SYNC_STRT=0x01E9 V_SYNC_WID=0x22
H_SYNC_DLY=0x01 GEN_CNTL =0x00 CLOCK_CTL =0x08 DOT_CLOCK =14.48Mhz h_frequency = 31.207KHz v_frequency = 59.44Hz
h_polarity = (-) XTAL = OFF v_polarity = (-) CS = OFF
h_sync_width = 3.867us 7 chars v_sync_width = 0.064ms 2 lines
h_front_porch = 0.622us 1 chars v_front_porch = 0.320ms 10 lines
h_back_porch = 2.141us 4 chars v_back_porch = 1.057ms 33 lines
h_active_time = 25.414us 46 chars v_active_time = 15.381ms 480 lines
h_blank_time = 6.630us 12 chars v_blank_time = 1.442ms 45 lines Mach64 CRT Parameter Timings for 368x600 60Hz non-interlaced mode:

H_TOTAL =0x3C H_DISP =0x2D H_SYNC_STRT=0x2F H_SYNC_WID=0x07
V_TOTAL =0x0273 V_DISP =0x0257 V_SYNC_STRT=0x0258 V_SYNC_WID=0x04
H_SYNC_DLY=0x02 GEN_CNTL =0x00 CLOCK_CTL =0x08 DOT_CLOCK =18.40Mhz h_frequency = 37.705KHz v_frequency = 60.04Hz
h_polarity = (+) XTAL = OFF v_polarity = (+) CS = OFF
h_sync_width = 3.043us 7 chars v_sync_width = 0.106ms 4 lines
h_front_porch = 0.978us 2 chars v_front_porch = 0.027ms 1 lines
h_back_porch = 2.500us 6 chars v_back_porch = 0.610ms 23 lines
h_active_time = 20.000us 46 chars v_active_time = 15.913ms 600 lines
h_blank_time = 6.522us 15 chars v_blank_time = 0.743ms 28 lines Mach64 CRT Parameter Timings for 384x480 60Hz non-interlaced mode:

H_TOTAL =0x3B H_DISP =0x2F H_SYNC_STRT=0x30 H_SYNC_WID=0x27
V_TOTAL =0x020C V_DISP =0x01DF V_SYNC_STRT=0x01E9 V_SYNC_WID=0x22
H_SYNC_DLY=0x02 GEN_CNTL =0x00 CLOCK_CTL =0x08 DOT_CLOCK =15.11Mhz

| | | | |
|---|---|---|---|
| h_frequency = 31.479KHz | | v_frequency = 59.96Hz | |
| h_polarity = (-) | XTAL = OFF | v_polarity = (-) | CS = OFF |
| h_sync_width = 3.706us | 7 chars | v_sync_width = 0.064ms | 2 lines |
| h_front_porch = 0.662us | 1 chars | v_front_porch = 0.318ms | 10 lines |
| h_back_porch = 1.985us | 4 chars | v_back_porch = 1.048ms | 33 lines |
| h_active_time = 25.414us | 48 chars | v_active_time = 15.248ms | 480 lines |
| h_blank_time = 6.353us | 12 chars | v_blank_time = 1.430ms | 45 lines |

Mach64 CRT Parameter Timings for 384x600 60Hz non-interlaced mode:

H_TOTAL =0x3E H_DISP =0x2F H_SYNC_STRT=0x31 H_SYNC_WID=0x08
V_TOTAL =0x0273 V_DISP =0x0257 V_SYNC_STRT=0x0258 V_SYNC_WID=0x04
H_SYNC_DLY=0x03 GEN_CNTL =0x00 CLOCK_CTL =0x08 DOT_CLOCK =19.20Mhz

| | | | |
|---|---|---|---|
| h_frequency = 38.095KHz | | v_frequency = 60.66Hz | |
| h_polarity = (+) | XTAL = OFF | v_polarity = (+) | CS = OFF |
| h_sync_width = 3.333us | 8 chars | v_sync_width = 0.105ms | 4 lines |
| h_front_porch = 0.990us | 2 chars | v_front_porch = 0.026ms | 1 lines |
| h_back_porch = 1.927us | 5 chars | v_back_porch = 0.604ms | 23 lines |
| h_active_time = 20.000us | 48 chars | v_active_time = 15.750ms | 600 lines |
| h_blank_time = 6.250us | 15 chars | v_blank_time = 0.735ms | 28 lines |

We claim:

1. A method of drawing moving images on a graphics display comprising:

(a) receiving data defining an input image in a predetermined resolution, (b) commanding a graphics processor to draw a corresponding image frame on a display having a number of scanning lines which is a multiple m of a number of scanning lines of the input image and a multiple n of a number of pixels in a horizontal line of the input image, (c) drawing successive lines of the input image on a first and on each $m^{th}$ scanning line of the graphics display, while stretching each pixel on each drawn line over n pixels, (d) copying each drawn line on respective immediately following m−1 lines, and (e) repeating steps (b)–(d) for successive frames of the input image.

2. A method as defined in claim 1 including carrying out the stretching step by reducing an original horizontal clock rate of the display to 1/n of said original clock rate.

3. A method as defined in claim 2 in which said original clock rate is a clock rate for controlling display of a maximum number of horizontal pixels capable by the display.

4. A method as defined in claim 1 including carrying out step (c) by a blit engine.

5. A method as defined in claim 4 including the step of storing data representing a frame of the input image in a memory accessible by the blit engine, for access and copying of lines of data by the blit engine.

6. A method as defined in claim 1 in which m=2 and n is approximately=2.

* * * * *